United States Patent [19]

Wake

[11] Patent Number: 4,676,432

[45] Date of Patent: Jun. 30, 1987

[54] SHEET RECEIVING APPARATUS

[75] Inventor: David E. Wake, Hants, England

[73] Assignee: De La Rue Systems Limited, England

[21] Appl. No.: 791,412

[22] Filed: Oct. 24, 1985

[30] Foreign Application Priority Data

Oct. 31, 1984 [GB] United Kingdom ..... 8427551

[51] Int. Cl.[4] ..... G07B 15/00

[52] U.S. Cl. ..... 232/43.2; 232/16

[58] Field of Search ..... 232/12, 15, 16, 43.2; 221/186, 191, 287; 109/24.1

[56] References Cited

U.S. PATENT DOCUMENTS

| | | | |
|---|---|---|---|
| 2,973,139 | 2/1961 | Leone et al. | 232/15 |
| 3,433,185 | 3/1969 | Roberts | 232/15 X |
| 3,926,366 | 12/1975 | Sciortino | 232/16 X |
| 4,113,140 | 9/1978 | Graf et al. | 221/6 |
| 4,186,977 | 2/1980 | Gilovich et al. | 232/15 X |
| 4;423,826 | 1/1984 | Hirata et al. | 232/15 X |

FOREIGN PATENT DOCUMENTS 807880 1/1959 United Kingdom .

*Primary Examiner*—Robert P. Swiatek

*Attorney, Agent, or Firm*—Ostrolenk, Faber, Gerb & Soffen

[57] ABSTRACT

Sheet receiving apparatus for a cash dispenser comprises a sheet container (18) to which a lid (19) is pivotally connected. A T-shaped moulding (24) is positioned in the lid (19) to lock the lid to the container (18) when the lid is in a closed position. A lock retainer comprising a pin (51) is also mounted in the lid (19) for retaining the moulding (24) in an unlocked position (not shown). A head portion (52) of the pin (51) is operable to disengage the pin (51) from the moulding (24) by cooperating with a cam and slot arrangement (61, 64) in a housing (59) of the cash dispenser. Upon insertion of the container (18) into the housing (59), the pin (51) is received in a diagonally extending slot (61) so that the lid (19) is caused to open. In addition, the slot (61) has a laterally outwardly extending cam portion (64) which acts on the head portion (62) of the pin (51) to withdraw the pin from engagement with the moulding (24). Upon withdrawal of the pin, the moulding (24) is urged into its locking position so that on withdrawal of the container (18) from the housing (59), the lid (19) is automatically locked to the container (18).

9 Claims, 7 Drawing Figures

Fig.1.
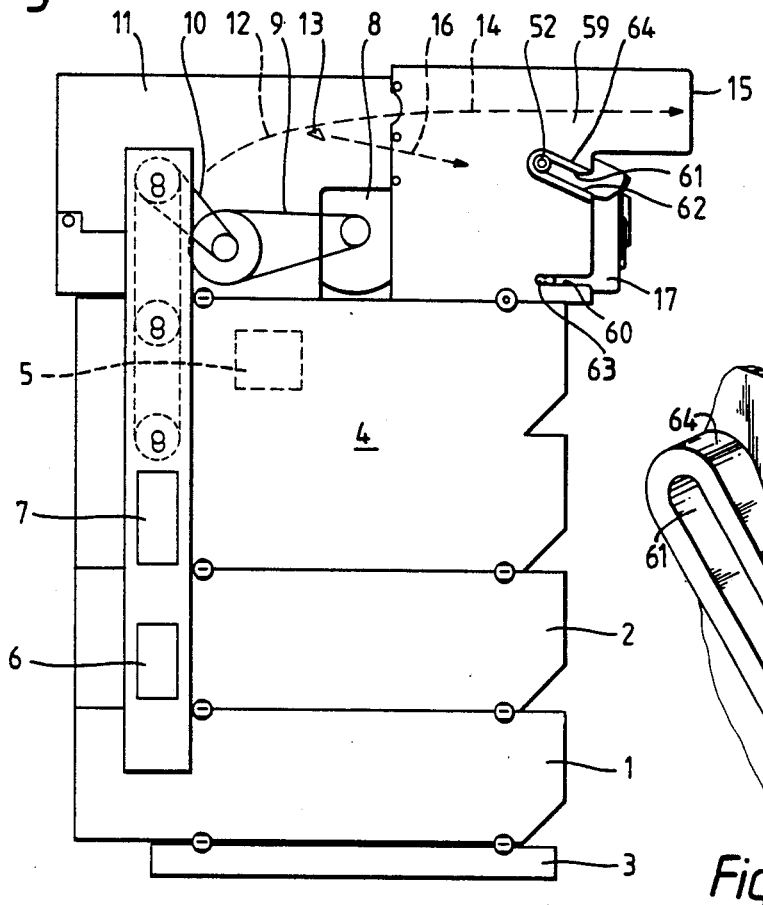
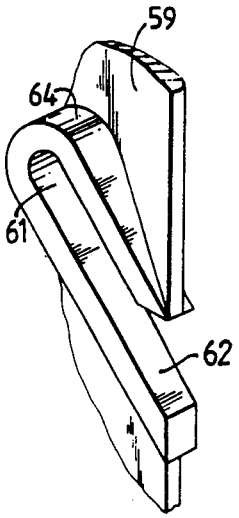
Fig.1A.
Fig.2.
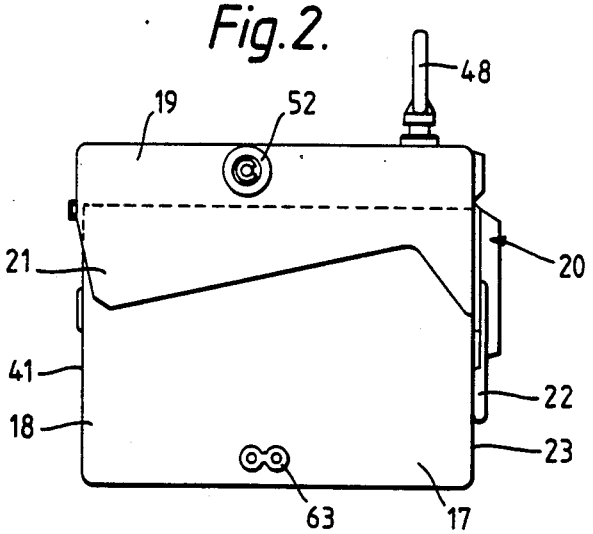

SHEET RECEIVING APPARATUS

FIELD OF THE INVENTION

The invention relates to sheet receiving apparatus, for example for use with cash dispensing apparatus for dispensing a specified amount of cash in the form of banknotes to a user of the apparatus.

BACKGROUND OF THE INVENTION

In cash dispensing apparatus it is necessary to provide a container for unacceptable notes (e.g. doubles and the like). The interior of the container should be inaccessible to unauthorised personnel when notes are present in the container.

BRIEF DESCRIPTION OF THE INVENTION

In accordance with the present invention, sheet receiving apparatus comprises a sheet container to which a lid is pivotally connected; locking means for locking the lid to the container when the lid is in a closed position; a lock retainer for retaining the locking means in an unlocked position; lock retainer disengagement means operable to disengage the lock retainer; and a housing having actuator means, wherein the lock retainer disengagement means cooperates with the actuator means to disengage the lock retainer when the sheet container is inserted into the housing and to cause the lid to pivot in open and closed directions when the container is inserted into and withdrawn from the housing respectively, the arrangement being such that on insertion of the container into the housing the lock retainer is disengaged whereby when the container is withdrawn from the housing the lid is locked to the container by the locking means.

This sheet receiving apparatus is particularly useful since the lid is automatically locked to the sheet container when the container is removed from the apparatus thereby considerably increasing security where the sheets are banknotes or other security documents. Furthermore the lid is automatically opened and closed on insertion into and withdrawal from the housing respectively.

Preferably, the lock retainer comprises a laterally slidable pin urged in a direction to engage the locking means, the lock retainer disengagement means comprising a lateral outer head portion of the pin having a larger dimension than the shank of the pin transverse to the length of the shank, the actuator means comprising a cam for engaging the head portion of the pin.

It is particularly convenient if the actuator means comprises a ramp which may be provided by open ended slot in which the pin slides, the head portion of the pin engaging a laterally outer surface of the slot which is shaped so that the pin is drawn in a laterally outward direction on insertion of the container into the housing.

BRIEF DESCRIPTION OF THE FIGURES

In order that the invention may be better understood, an embodiment of a reject bin and a case dispenser incorporating such a bin according to the invention will now be described with reference to the accompanying drawings, in which:

FIG. 1 is a schematic side elevation of the cash dispenser;

FIG. 1A is an enlarged, perspective view of a detail from FIG. 1;

FIG. 2 is a side elevation of the reject bin;

DETAILED DESCRIPTION OF THE INVENTION

Figure 3:
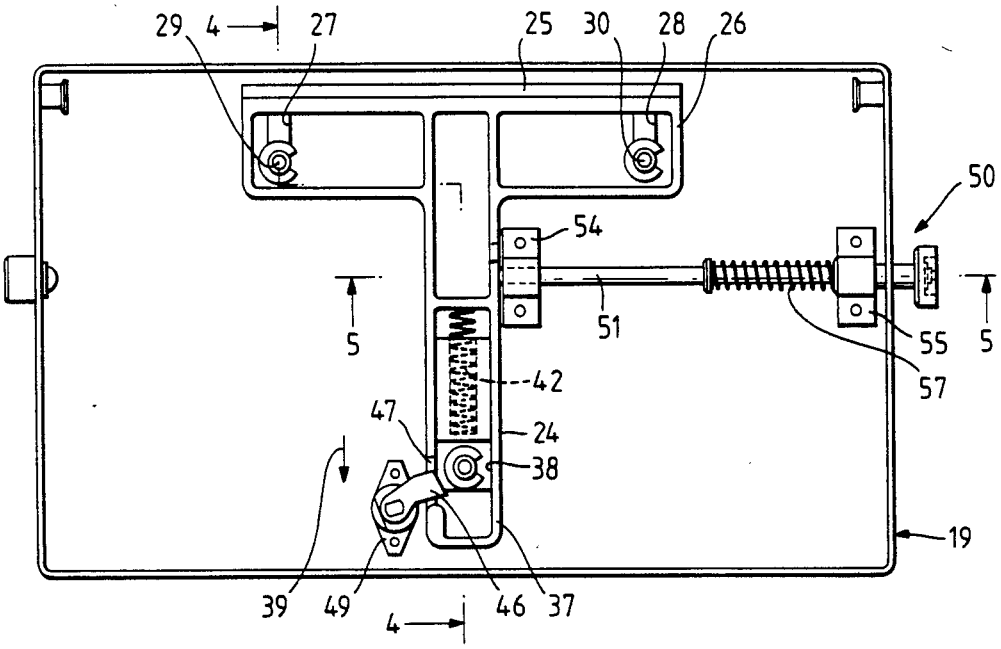
FIG. 3 is a plan of the internal construction of the lid of the reject bin shown in FIG. 2.

The cash dispenser illustrated in FIG. 1 comprises a housing (omitted for clarity in the drawing) which supports two currency cassettes 1, 2 of conventional form on a base 3. The currency cassettes 1, 2 will typically contain banknotes of different denominations such as sterling £5 and £10 notes. A delivery module 4 is positioned above the cassette 2 and includes a microcomputer illustrated schematically at 5 for controlling operation of the cash dispenser. A pair of feed modules 6, 7 are mounted adjacent respective cassettes 1, 2 to withdraw single banknotes from the cassettes in response to instructions from the microcomputer 5. These banknotes are fed upwardly through the dispenser under the control of a belt feed system (not shown) driven by a motor 8 via drive belts 9, 10.

When the banknotes reach an upper section 11 of the cash dispenser they are fed along a path indicated schematically at 12 to a diverter 13. The diverter 13 is operable in response to instructions from the microcomputer 5 to guide banknotes arriving at the diverter 13 either along a path 14 to a dispense outlet 15 or along a path 16 to a reject bin 17 to be described in more detail below.

In use, a user indicates via a conventional keyboard the sum of money he wishes to have dispensed and the microcomputer 5 determines from the keyboard instructions the correct number of banknotes to be withdrawn from the cassettes 1, 2. During passage of these banknotes from the cassettes to the diverter 13, various tests are carried out including at least a doubles detect test of conventional form to check that the banknotes are being correctly fed. If the banknotes are correctly fed then the diverter 13 is caused to guide the banknotes to the dispense outlet 15. If an incorrect feed is determined then the microcomputer 5 will cause the diverter 13 to guide the banknotes to the reject bin 17.

The reject bin 17 is illustrated in FIG. 2 and comprises a container portion 18 and a lid 19 hinged to the container portion 18 at a portion 20. The material from which the container 17 is constructed is a suitable tamper proof material such as steel. It will be seen in FIG. 2 that the lid 19 has a downwardly extending portion 21 which overhangs the top edge of the container portion 18. The reason for this is that when the lid 19 is opened, as will be described below, in the cash dispensing apparatus, the portion 21 will still overhang part of the wall of the container portion 18 to prevent unauthorised side access to the interior of the container portion 18. A pivoted carrying handle 22 is mounted to a rear wall 23 of the container portion 18.

The purpose of the reject bin 17 is to receive incorrectly fed notes from the cash dispenser, as previously described. For this reason, it is important when the reject bin 17 is withdrawn from the cash dispenser that unauthorised access to the contents of the bin is prevented. This is achieved by ensuring that the lid 19 is locked to the container portion 18 on withdrawal.

Figure 4:
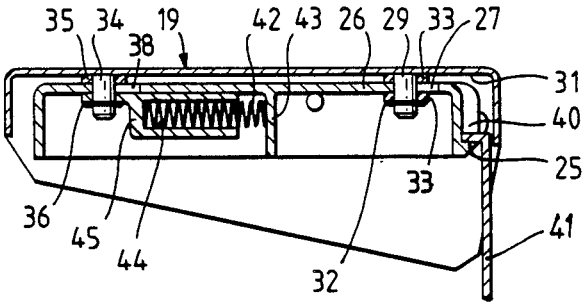
FIG. 4 is a section taken on the line 4—4 in FIG. 3.

The lid 19 is illustrated in more detail in FIG. 3. Within the lid 19 is positioned a plastics moulding 24 having a T-shape with a flange 25 extending along the leading edge of a head portion 26 of the moulding 24. The head portion 26 includes a pair of slots 27, 28 which receive respective pins 29, 30 secured to an undersurface 31 of the lid 19. Parts of the moulding 24 are sandwiched between respective pairs of washers 32 on each pin 29, 30 secured by a circlip 33. (FIG. 4).

A further pin, washer, circlip assembly 34, 35, 36 is mounted to the undersurface 31 of the lid 19 in alignment with a tail portion 37 of the moulding 24. The pin 34 passes through an aperture 38 in the tail portion 37 to support the tail portion.

The pin and slot arrangements described above support the moulding 24 in the lid 19 and permit the moulding 24 to move between a lid locking position shown in FIG. 3 and a retracted position (not shown) in which the moulding 24 is moved in the direction of the arrow 39. As can be seen in FIG. 4, in the lid locking position the flange 25 engages a flange 40 extending along the upper edge of a front wall 41 of the container 18. In this position, the lid 19 cannot be opened.

The moulding 24 is urged towards the lid locking position shown in FIG. 3 by a compression spring 42 one end of which engages an integral, depending web 43 of the moulding 24 and the other end of which is received in a blind channel 44 in a block 45 fixed to the lid 19 via the pin 34.

The moulding 24 may be moved against the resilience of the compression spring 42 into its unlocked position by means of a key operated pawl 46 received in a slot 47 of the tail portion 37 of the moulding 24. To unlock the lid, a key 48 (FIG. 2) is inserted into a lock 49 and turned in a clockwise direction (as seen in FIG. 3) so that the pawl 46 engages a wall of the slot 47 to draw the moulding 24 towards its unlocked position.

A lock retainer assembly 50 is also provided in the lid 19. The assembly 50 comprises an elongate pin 51 having a head portion 52, the pin 51 extending through a side wall 53 of the lid 19 and being supported by a pair of support blocks 54, 55 bonded to the lid 19. The pin 51 has a washer 56 fixed at a mid point about the pin and a compression spring 57 extends between the washer 56 and a facing wall of the block 55. Thus, the compression spring 57 causes the pin 51 to be urged towards the tail portion 37 of the moulding 24.

The tail portion 37 includes an aperture 58 having a similar diameter to the diameter of the pin 51 which, when the moulding 24 is in the unlocked position, is in alignment with the pin 51. In this position (FIG. 5A) the pin 51 will be urged through the aperture 58 and thus retain the moulding against the resilience of the compression spring 42 in the unlocked position.

Figure 5A:
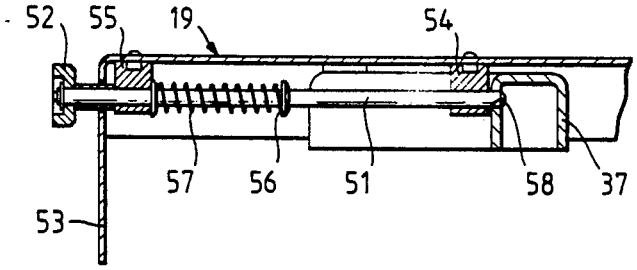
FIGS. 5*a* and 5*b* are sections taken on the line 5—5 in FIG. 3 illustrating the locking pin in two different positions.
Figure 5B:
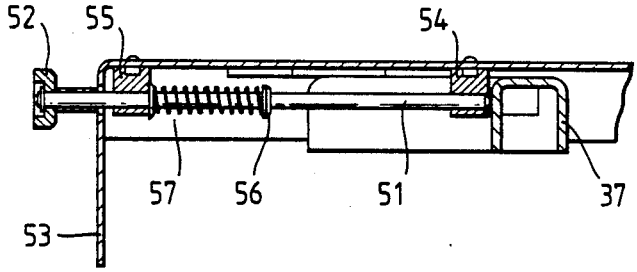

When the moulding 24 is in the locked position, the pin 51 will be withdrawn from the aperture 58 and be urged against a wall of the tail portion 37 (FIG. 5B).

In use, when it is desired to position the reject bin 17 in the cash dispenser, the key operated lock 49 is actuated to draw the moulding 24 towards the unlocked position at which point the pin 51 is urged into the aperture 58 to retain the moulding 24 in the unlocked position (FIG. 5A). The reject bin 17 is then inserted into a housing part 59 of the cash dispenser. The housing part 59 includes a pair of horizontally extending slots in opposite side walls, one of which 60 is illustrated in FIG. 1. The side wall illustrated in FIG. 1 of the housing portion 59 also includes a diagonally extending slot 61 defining a ramp surface 62. As the reject bin 17 is inserted into the housing portion 59, a pair of locating lugs are received in respective horizontal extending slots. FIG. 1 illustrates a locating lug 63 being received in the slot 60. In addition, the projecting portion of the pin 51 is received in the slot 61. It will be seen therefore that as the reject bin 17 is inserted into the housing portion 59, the pin 51 will be guided in a diagonally upward direction thus causing the lid 19 to pivot into its open position.

In addition, the slot 61 has a laterally outwardly projecting cam section 64 (FIG. 1A). The cam section 64 acts against a laterally inwardly facing portion of the pin head portion 52 thereby gradually drawing the pin 51 in a laterally outward direction. Since initially the pin 51 is received in the slot 58 of the moulding 24, this laterally outward movement will withdraw the pin from the aperture 58 thus allowing the moulding 24 to move under the influence of the compression spring 42 to its locking position shown in FIG. 3. The slot 61 and cam section 64 are arranged so that the moulding 24 is not released until the flange 25 has cleared the flange 40.

When it is desired to remove the reject bin 17, the bin is drawn out by means of the handle 22. As the bin 17 is withdrawn, the pin 51 is again guided in a diagonally downward direction by the slot 61 to force the lid 19 towards its closed position. In addition, the pin 51 will be urged laterally inwardly under the influence of spring 57 until it rests against a wall of the moulding 24 (FIG. 5B). The spacing between the entry position of the slot 62 and the slot 60 is such that by this point, the lid 19 will be forced to its fully closed position at which the flange 25 of the moulding 24 will have engaged under the flange 40 of the wall of the container 18. This is shown in FIG. 4. The lid can now only be opened by making use of the key operated lock 49.

I claim:

1. Sheet receiving apparatus comprising a sheet container; a lid pivotally connected to said container, said lid being pivotable between open and closed positions; locking means for locking said lid to said container when said lid is in said closed position; a lock retainer for retaining said locking means in an unlocked position; lock retainer disengagement means operable to disengage said lock retainer; and a housing having actuator means, said lock retainer disengagement means cooperating with said actuator means to disengage said lock retainer when said sheet container is inserted into said housing and to cause said lid to pivot towards said open and closed positions when said container is inserted into and withdrawn from said housing respectively, whereby on insertion of said container into said housing said lock retainer is disengaged so that when said container is withdrawn from said housing said lid is locked to said container by said locking means.

2. Apparatus according to claim 1, wherein said container includes a flange, and wherein said locking means comprises a locking member slidably mounted in said lid, said locking member having a latch and being urged in a direction in which said latch will engage said flange of said container when said lid is in said closed position.

3. Apparatus according to claim 1, wherein said lock retainer comprises a laterally slidable pin having a shank and a lateral outer head portion and urged in a direction to engage said locking means, said lock retainer disengagement means comprising said lateral outer head portion of said pin having a larger dimension than said shank of said pin transverse to said shank, said actuator means comprising a cam for engaging said head portion of said pin.

4. Apparatus according to claim 1, wherein said actuator means comprises a ramp along which said lock retainer disengagement means is adapted to ride to open and close said lid.

5. Apparatus according to claim 4, wherein said lock retainer comprises a laterally slidable pin having a shank and a lateral outer head portion and urged in a direction to engage said locking means, said lock retainer disengagement means comprising said lateral outer head portion of said pin having a larger dimension than said shank of said pin transverse to said shank, said actuator means comprising a cam for engaging said head portion of said pin, and wherein said cam comprises an open ended slot in which said pin slides, said head portion of said pin engaging a laterally outer surface defined by said slot, said surface being shaped so that said pin is drawn in a laterally outward direction on insertion of said container into said housing.

6. Apparatus according to claim 1, wherein said lock retainer comprises a laterally slidable pin having a shank and a lateral outer head portion and urged in a direction to engage said locking means, said lock retainer disengagement means comprising said lateral outer head portion of said pin having a larger dimension than said shank of said pin transverse to said shank, said actuator means comprising a cam for engaging said head portion of said pin, and wherein said pin is mounted in said lid and is received, in said retaining position, in an aperture defined by a portion of said locking means.

7. Apparatus according to claim 1, wherein said lock retainer comprises a laterally slidable pin having a shank and a lateral outer head portion and urged in a direction to engage said locking means, said lock retainer disengagement means comprising said lateral outer head portion of said pin having a larger dimension than said shank of said pin transverse to said shank, said actuator means comprising a cam for engaging said head portion of said pin, wherein said container includes a flange, and wherein said locking means comprises a locking member slidably mounted in said lid, said locking member having a latch and being urged in a direction in which said latch will engage said flange of said container when said lid is in said closed position.

8. Apparatus according to claim 7, wherein said actuator means comprises a ramp along which said lock retainer disengagement means is adapted to ride to open and close said lid.

9. Cash dispensing apparatus including at least one store of banknotes to be dispensed; diverting means; delivery means for delivering a selected quantity of banknotes from said at least one store of said diverting means; a dispensing outlet; sheet receiving apparatus comprising a sheet container; a lid pivotally connected to said container, said lid being pivotable between open and closed positions; locking means for locking said lid to said container when the lid is in said closed position; a lock retainer for retaining said locking means in said unlocked position; lock retainer disengagement means operable to disengage said lock retainer; and a housing having actuator means, wherein said lock retainer disengagement means cooperates with said actuator means to disengage said lock retainer when said sheet container is inserted into said housing and to cause said lid to pivot towards said open and closed positions when said container is inserted into and withdrawn from said housing respectively, whereby on insertion of said container into said housing said lock retainer is disengaged so that when said container is withdrawn from said housing said lid is locked to said container by said locking means; and control means for determining whether a correct quantity of banknotes has been fed to said diverting means and for causing said diverting means to guide banknotes into said container on detecting an incorrect quantity.

* * * * *